US007641193B2

(12) United States Patent
Barinaga et al.

(10) Patent No.: US 7,641,193 B2
(45) Date of Patent: Jan. 5, 2010

(54) SHEET BENDING

(75) Inventors: Louis C. Barinaga, Vancouver, WA (US); Robert M. Yraceburu, Camas, WA (US); Jason S. Belbey, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 233 days.

(21) Appl. No.: 11/555,151

(22) Filed: Oct. 31, 2006

(65) Prior Publication Data

US 2008/0098790 A1 May 1, 2008

(51) Int. Cl.
*B65H 5/02* (2006.01)

(52) U.S. Cl. ..... 271/277; 271/272

(58) Field of Classification Search ..... 271/272, 271/277

See application file for complete search history.

(56) References Cited

U.S. PATENT DOCUMENTS

| | | | | | |
|---|---|---|---|---|---|
| 1,698,083 | A | | 1/1929 | Booth | |
| 1,709,002 | A | | 4/1929 | Booth | |
| 2,384,768 | A | * | 9/1945 | Rau | 156/364 |
| 3,546,067 | A | | 12/1970 | Heidepriem | |
| 3,957,366 | A | * | 5/1976 | Taylor et al. | 399/394 |
| 4,320,854 | A | * | 3/1982 | Hirose | 221/12 |
| 4,326,915 | A | | 4/1982 | Mutschler | |
| 4,955,964 | A | | 9/1990 | Hain | |
| 5,017,970 | A | | 5/1991 | Sakata | |
| 5,066,984 | A | | 11/1991 | Coombs | |
| 5,267,826 | A | * | 12/1993 | Peters | 414/789.9 |
| 5,287,157 | A | | 2/1994 | Miyazato et al. | |
| 5,539,511 | A | | 7/1996 | Wenthe et al. | |
| 5,555,083 | A | | 9/1996 | Kuo et al. | |
| 5,565,971 | A | * | 10/1996 | Kuo et al. | 399/406 |
| 5,789,727 | A | * | 8/1998 | Teradaira et al. | 235/449 |
| 5,848,347 | A | * | 12/1998 | Kuo et al. | 399/406 |
| 5,978,645 | A | | 11/1999 | Miyazaki | |
| 6,042,106 | A | * | 3/2000 | Kelly et al. | 271/188 |
| 6,196,541 | B1 | | 3/2001 | Silverbrook | |
| 6,246,860 | B1 | * | 6/2001 | Ohmichi | 399/406 |
| 6,473,592 | B2 | * | 10/2002 | Nishio | 399/406 |
| 6,496,680 | B2 | * | 12/2002 | Fujimoto et al. | 399/329 |
| 6,619,657 | B2 | * | 9/2003 | Horikoshi et al. | 271/188 |
| 6,666,809 | B1 | * | 12/2003 | John | 493/461 |
| 6,682,190 | B2 | * | 1/2004 | Rasmussen et al. | 347/104 |
| 6,808,259 | B2 | * | 10/2004 | Rasmussen et al. | 347/104 |
| 6,991,130 | B2 | * | 1/2006 | Presutti et al. | 221/73 |
| 7,110,711 | B2 | * | 9/2006 | Tomatsu | 399/322 |
| 7,128,236 | B2 | * | 10/2006 | Presutti et al. | 221/73 |
| 7,379,703 | B2 | * | 5/2008 | Ito | 399/406 |
| 2001/0022427 | A1 | * | 9/2001 | Ito | 271/272 |
| 2004/0050497 | A1 | * | 3/2004 | Presutti et al. | 156/349 |
| 2004/0251618 | A1 | * | 12/2004 | Niizeki | 271/272 |

FOREIGN PATENT DOCUMENTS

| | | | |
|---|---|---|---|
| JP | 06239002 | A * | 8/1994 |
| JP | 08012162 | A * | 1/1996 |

* cited by examiner

*Primary Examiner*—Patrick H Mackey
*Assistant Examiner*—Howard Sanders

(57) ABSTRACT

Various apparatus and methods for bending a sheet of media are disclosed.

23 Claims, 8 Drawing Sheets

SHEET BENDING

BACKGROUND

During printing and other sheet handling operations, a sheet of media may develop a set or curl. This curl may cause many problems including poor stackability and media jams.

DETAILED DESCRIPTION OF THE EXAMPLE EMBODIMENTS

Figure 1:
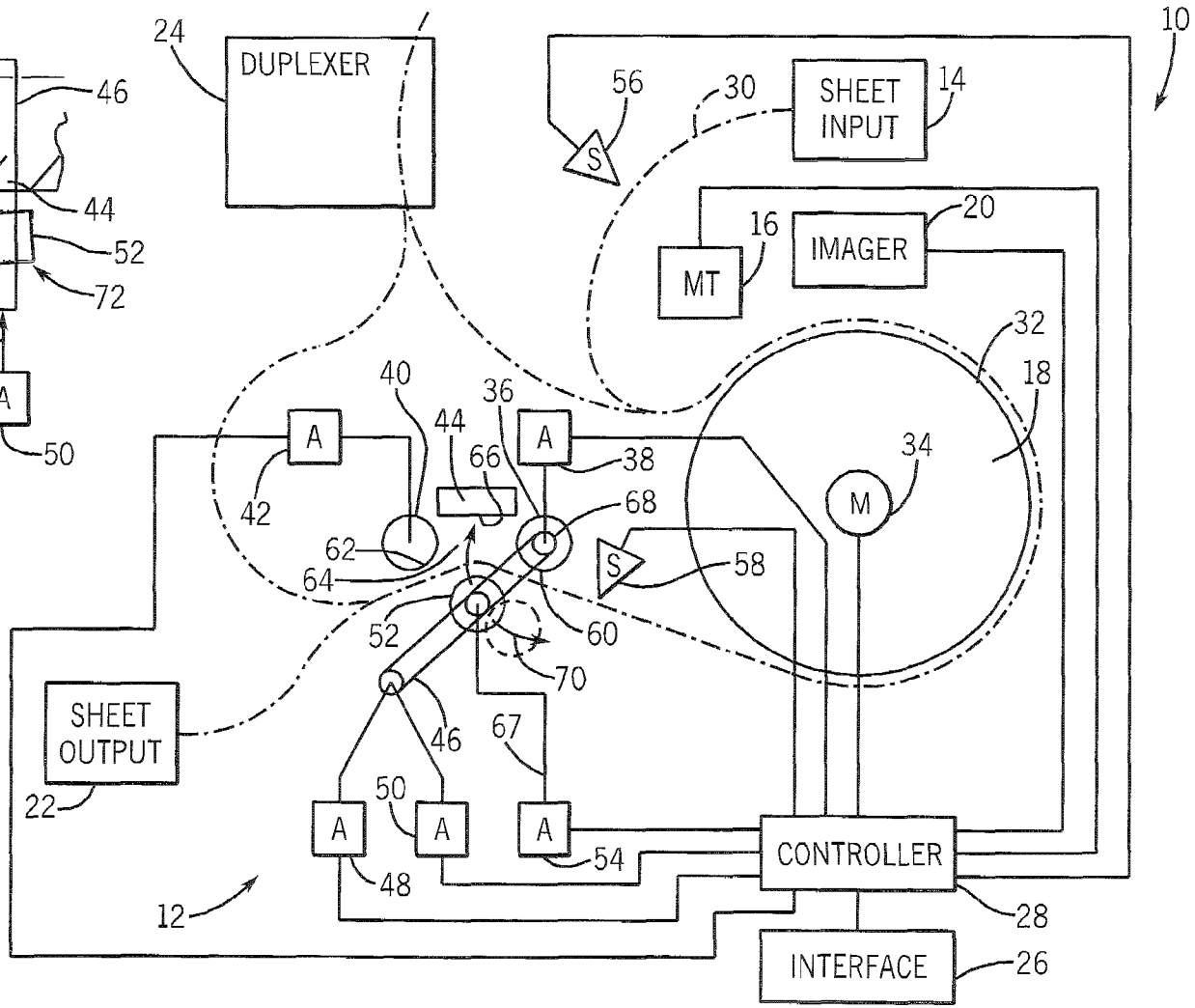
FIG. 1 is an end view schematically illustrating an imaging apparatus according to one example embodiment.

FIG. 1 schematically illustrates an imaging apparatus 10 which includes a sheet de-curling or bending apparatus 12. Imaging apparatus 10 is configured to print or otherwise form images (text, graphics, photos, drawings and the like) upon sheets of media. During this process, the individual sheets may develop a set or curl. As will be described in more detail hereafter, sheet bending apparatus 12 at least reduces an extent to which each sheet is bent or curled, reducing the occurrence of jams and facilitating stacking of the sheets.

In addition to media bending apparatus 12, imaging apparatus 10 includes sheet input 14, media transport 16, media support 18, imager 20, sheet output 22, duplexer 24, interface 26 and controller 28. Sheet input 14 comprises one or more structures by which sheets of media are supplied to apparatus 10. In one embodiment, sheet input 14 may comprise a tray. In another embodiment, sheet input 14 may comprise a bin. In yet other embodiments, sheet input 14 may comprise a feed from another external device.

Media transport 16 comprises one or more mechanisms configured to engage and transport sheets of media along a media path 30. As shown by FIG. 1, media path 30 generally extends from sheet input 14, between support 18 and imager 20, through sheet bending apparatus 12 and to either sheet output 22 or duplexer 24. Media path 30 further extends from duplexer 24 back to between support 18 and imager 20 for duplexing. Media path 30 may be defined by one or more stationary structures which form passages or channels. Media path 30 may additionally be at least partially defined by components of media transport 16. Such components of media transport 16 may be located at various positions along an entire length of media path 30. Such components of media transport 16 include, but are not limited to, driven and non-driven rollers, driven and non-driven belts, flippers, flaps and guides which actuate between different positions to selectively channel or direct media between different paths, such as to sheet output 22 or to duplexer 24, and other devices configured to guide and move sheets of media.

Support 18 comprises a structure configured to support and position a sheet of media opposite to imager 20 as an image is being formed upon the sheet. In the particular embodiment illustrated, support 18 further assists in transporting the sheet along media path 30. In the particular example illustrated, support 18 comprises a cylinder or drum having an cuter circumferential surface 32 against which a sheet of media is held as the drum is rotationally driven by a motor 34. For purposes of this disclosure, the term "rotationally driven" as it applies to drums or rollers shall mean that the drum or roller is rotated under power from a motor or other actuator independent of any force applied to the drum or roller by a sheet of media being moved along the drum a roller. For example, an idling roller that only rotates as a result of being contacted by a moving sheet of media is not a "rotationally driven" roller. Because support 18 comprises a drum or cylinder, sheets of media may be more likely to develop a set or curl.

In yet other embodiments, support 18 may alternatively be stationary. In other embodiments, support 18 may be flat or curved without being cylindrical. For example, in another embodiment, support 18 may comprise a relatively flat horizontal platen across which a sheet of media is moved while being printed upon.

Imager 20 comprises one or more mechanisms or components configured to print or otherwise form an image upon the face of a sheet of media being supported by support 18. In one embodiment, imager 20 comprises one or more ink jet, drop-on-demand print heads. For example, in one embodiment, imager 20 may include a page-wide-array of print heads which extend substantially across the width of a sheet of media to be printed upon. In another embodiment, imager 20 may include one or more print heads which are scanned or moved across the width of a sheet of media to be printed upon. In still other embodiments, imager 20 may be configured to form an image upon sheets of media in other fashions. For example, imager 20 may comprise an electrophotographic imaging device configured to form an image using dry or liquid toner.

Sheet output 22 comprises one or more structures which receive printed upon sheets generally at an end of media path 30. In one embodiment, sheet output 22 comprises a tray or bin for storing such received sheets and for providing access to such sheets. In other embodiments, sheet output 22 may comprise an interface between imaging apparatus 10 and another media treatment device, such as a collator, stapler, folder and the like which may be incorporated as part of imaging apparatus 10 or which may be a separate external device.

Duplexer 24 comprises an arrangement of components configured to facilitate the formation of an image on opposite faces of a single sheet of media. In the example illustrated, duplexer 24 is located along media path 30 and is configured to flip or overturn a printed upon sheet of media and to redirect a sheet of media back to imager 20 for printing upon a second side of the sheet of media. In one embodiment, duplexer 24 may comprise an arrangement of rotationally driven rollers configured to reverse direction of a sheet back towards imager 20. In yet other embodiments, duplexer 24 may be omitted.

Interface 26 comprises one or more devices configured to facilitate the input of commands, selections and/or data to controller 28. In one embodiment, interface 26 is configured to enable a person to input such information. Examples of such a human interfaces include, but are not limited to, a keyboard, a mouse, a touch screen, a touchpad, one or more switches or buttons, or a microphone with associated speech recognition software. In particular embodiments, interface 26 may include a display or monitor for presenting information or selections to a person. In other embodiments, interface 26 may be configured to facilitate input of electrical signals representing such commands, selections or data from other external electronic devices. In other embodiments, interface 26 may be omitted.

Controller 28 comprises one or more processing units configured to monitor imaging apparatus 10, to receive and analyze sensed information from various sensors of imaging apparatus 10, to receive commands, selections and data via interface 26 and to generate control signals directing operation of various components or elements of imaging apparatus 10 including sheet bending apparatus 12.

For purposes of this application, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. For example, controller 28 may be embodied as part of one or more application-specific integrated circuits (ASICs). Unless otherwise specifically noted, the controller is not limited to any specific combination of hardware circuitry and software, nor to any particular source for the instructions executed by the processing unit.

Sheet bending apparatus 12 bends and deforms sheets of media. In the particular example illustrated, sheet bending apparatus bends such sheets after such sheets have been printed upon. In lieu of being incorporated as part of imaging apparatus 10, sheet bending apparatus 12 may be incorporated into other sheet handling or sheet treatment devices.

Sheet bending apparatus 12 includes roller 36, actuator 38, roller 40, actuator 42, backing 44, swing arm 46, actuators 48, 50, roller 52, actuator 54, sensor 56 and sensor 58. Rollers 36 and 40 comprise a pair of rollers extending along substantially parallel axes. Rollers 36 and 38 provide sheet contacting points or surfaces 60 and 62 which are separated or spaced from one another by a gap 64. It is within this gap 64 that bending of a sheet between surfaces 60 and 62 occurs. Because rollers 36 and 40 are rotationally driven, rollers 36 and 40 assist in moving a sheet of media into position across gap 64.

In the particular example illustrated, each of rollers 36 and 40 is independently rotationally driven. In particular, actuator 38 rotationally drives roller 36 while actuator 42 rotationally drives roller 40. Actuators 38 and 42 may comprise any of a variety of rotary actuators such as motors operably coupled to rollers 36 and 40 by appropriate transmissions or drive trains. Because rollers 36 and 40 may be driven at different speeds relative to one another, sheets of media may be additionally stretched during bending or additional time may be provided for such bending.

In other embodiments, rollers 36 and 40 may be rotationally driven at the same speed (be it surface speed or rotational speed). In such embodiments, a single actuator may be used to rotationally drive both rollers 36 and 40. In particular embodiments, actuators 38 and 42 may be omitted where other mechanisms are provided to move a sheet of media across gap 64. In some embodiments, rollers 36 and 38 may be replaced with stationary non-rotating structures which provide surfaces 60 and 62 that are spaced to form a gap 64 therebetween for bending a sheet.

Backing 44 comprises a structure stationarily positioned with respect to surfaces 60 and 62 that provides a surface 66 within or behind gap 64 between surfaces 60 and 62 and generally opposite to roller 52. Surface 66 is substantially inflexible such that surface 66 undergoes deminimus movement or deformation in circumstances when roller 52 is urging a sheet of media against surface 66. Surface 66 acts similar to an anvil by enabling a portion of a sheet to be moved against surface 66 while opposite sides of a portion are bent within gap 64 against surfaces 60 and 62. In particular embodiments, backing 44 may be omitted.

Swing arm 46 comprises a structure configured to support roller 52 at various positions with respect to gap 64 and backing 44. In the particular embodiments illustrated, swing arm 46 pivots about axis 68 such that roller 52 may be positioned at a variety of locations along an arc 70 centered about axis 68. In the example illustrated, swing arm 46 is selectively moved between the different positions within gap 64 and along arc 70 by actuators 48 and 50.

Actuators 48 and 50 comprise mechanisms operably coupled to swing arm 46 that are configured to move swing arms 46 and roller 52 along arc 70. In one embodiment, actuators 48 and 50 may comprise separate motors and cams for moving swing arms 46. In other embodiments, actuators 48 and 50 may comprise a single motor, a pair of cams and a clutching arrangement for selectively actuating the cams. In yet another embodiment, linear actuators, such as hydraulic, pneumatic or electrical (i.e., a solenoid) linear actuators may be employed to move swing arms 46.

Figure 1A:
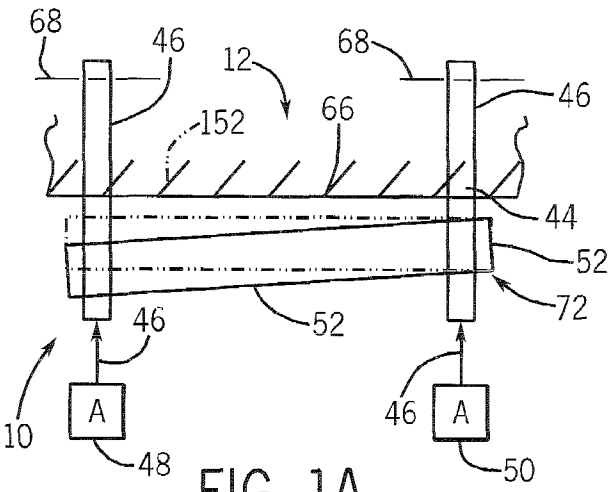
FIG. 1A is a fragmentary front view schematically illustrating a portion of a sheet bending apparatus of the imaging apparatus of FIG. 1 according to an example embodiment.

FIG. 1A schematically illustrates actuators 48 and 50 in more detail. As shown by FIG. 1A, actuators 48 and 50 are operably coupled to roller 52 by a pair of swing arms 46 (schematically illustrated) which pivot about axis 68. Actuators 48 and 50 are independently actuatable to pivot swing arms 46 so as to move ends 70 and 72 of roller 52 to different extents. As a result, roller 52 may be moved between a first orientation in which roller 52 extends along an axis substantially parallel (shown in phantom) to surface 66 of backing 44 and parallel to the axes of rollers 36 and 40 (shown in FIG. 1A) to a second orientation (shown in non-Phantom) in which roller 52 extends along an axis oblique to surface 66 of backing 44 and oblique to the axes of rollers 36 and 40 (shown in FIG. 1). In the second oblique orientation, opposite side edges of a sheet of media are differently interacted upon such that edges of the sheet of media moves through gap 64 differently. As a result, actuating roller 52 to the second oblique orientation may facilitate correction of sheet skew. In other embodiments, sheet bending apparatus 12 may alternatively include a single actuator (either 48 or 50) for actuating or moving roller 52 along arc 70, wherein roller 52 remains substantially parallel to surface 66 and rollers 36, 40 in its various positions.

Roller 52 comprises one or more rollers rotationally supported along an axis generally opposite to gap 64 by swing arms 46. In the particular embodiments illustrated, roller 52 is rotationally driven by actuator 54. Because roller 52 is rotationally driven, roller 52 assists in moving a sheet of media across gap 64. Such assistance is especially beneficial when thicker media is being bent.

Actuator 54 comprises a motor operably coupled to roller 52 by a drive train (schematically illustrated by line 67). According to one embodiment, the drive train 67 extends along and is supported by one of swing arms 46. According to one embodiment, the drive train 67 includes a rotational member, such as a gear, pulley or sprocket which also rotates about axis 68. Because a rotational member of the drive train rotates about axis 68 which is the same axis about which swing arm 46 rotates, the supply of torque to roller 52 to rotate roller 52 may be maintained at the various positions of roller 52 along arc 70. In other embodiments, roller 52 may be rotationally driven by other drive train arrangements. In still other embodiments, roller 52 may not be rotationally driven such that roller 52 idles or freely rotates.

Sensor 56 comprises one or more sensing elements configured to sense or otherwise detect a thickness of a sheet of media. Sensor 56 is located along media Path 30 ahead of sheet bending apparatus 12. Although illustrated as being located before support 18, sensor 56 may be alternatively located at other positions along media path 30. In certain embodiments, sensor 56 may be located at sheet input 14. In particular embodiments, sensor 56 may be omitted.

Sensor 58 comprises one or more sensing elements configured to sense or otherwise detect a skew of a sheet of media moving along media Path 30. In the example illustrated, sensor 58 is located as close as possible to an input side of media bending apparatus 12. In other embodiments, Sensor 58 may be provided at other locations. In still other embodiments, sensor 58 may be omitted.

In operation, one or more sheets of media are loaded into sheet input 14. Controller 28, in response to a printed command entered via an interface 26, generates control signals directing media transport 16 to extract a sheet from input 14, such as by using a pick roller or pick tire, so as to move the extracted sheet along media Path 30. During the transfer of the sheet along media path 30, sensor 56 detects a thickness of the sheet and transmits signals to controller 28 indicating the thickness. Alternatively, controller 28 may receive information entered via interface 26 indicating a thickness or type of media which is being printed upon. Controller 28 further generates control signals directing motor 34 to rotate support 18 to move the sheet to a position opposite to imager 20. Based upon control signals received from controller 28, imager 20 prints or otherwise forms an image upon the sheet. Thereafter, the printed upon sheet is moved further along media path 30 as a result of rotation of support 18 and is extracted from support 18 and moved into media bending apparatus 12. Prior to being received by media bending apparatus 12, sensor 58 detects any misalignment or skew of the sheet and transmits signals representing the detected skew to controller 28.

At sheet bending apparatus 12, actuator 38, in response to control signals from controller 28 engages and drives the sheet of media to position the sheet of media across gap 64. Actuators 48 and 50, in response to control signals from controller 28, pivot swing arm 46 about axis 68 so as to position roller 52 into engagement with the sheet of media in gap 64 so as to bend or deform the sheet. The extent to which roller 52 is moved by actuators 48 and 50 may be based upon either the sensed thickness of the sheet as detected by sensor 56 or based upon information input by a user or other electronic device via interface 26 regarding the thickness of the sheet. For example, for thicker media, controller 28 may generate control signals directing actuators 48 and 50 to move or pivot swing arm 46 so as to position roller 52 a greater distance into gap 64 so as to exert a greater bending force off on the sheet of media. For thinner or lighter media, the extent to which roller 52 is positioned within gap 64 may be reduced.

In addition, based upon signals received from sensor 58 representing any skew of the sheet of media, controller 28 may generate control signals causing actuators 38 and 42 to rotationally drive rollers 36 and 40 at different speeds or causing actuators 48 and 52 position ends 70 and 72 of roller 52 (shown in FIG. 1A) at different positions such that roller 52 is oblique. As a result, media bending apparatus 12 may additionally reduce or correct skew.

As the sheet of media is being moved through sheet bending apparatus 12, controller 28 also generates control signals causing actuator 54 to rotationally drive roller 52 and directing actuator 42 to rotationally drive roller 40 to continue moving the sheet of media out of apparatus 12. After at least partially passing through apparatus 12, the sheet of media is either directed to sheet output 22 or is directed to duplexer 24. If the sheet is directed to duplexer 24, the sheet is once again returned to support 18 and imager 20 for printing on an opposite face of the sheet. After printing is completed on the opposite face of the sheet, the sheet is once again passed through apparatus 12.

FIG. 1 illustrates one example of sheet bending apparatus 12. In other embodiments, sheet bending apparatus 12 may omit one or both of sensors 56 and 58. In particular embodiments, apparatus 12 may include a single actuator, wherein roller 52 is maintained in a substantially parallel orientation in each of its many potential positions with respect to surface 66. In other embodiments, actuators 48 and 50 may be omitted, wherein movement of swing arms 46 is performed manually through a lever and one or more detents and detent engaging members for selectively retaining swing arms 46 and roller 52 in one of a plurality of predetermined positions. In other embodiments, roller 52 may be moved with respect to surface 66 in other matters other than being pivoted. In other embodiments, rollers 36, 40 and 52 may be driven by a single actuator connected to each roller with a drive train. In other embodiments, rollers 36 and 40 may be driven by a single actuator. In still other embodiments, one or more of roller 36, 40 and 52 may not be rotationally driven, wherein other mechanisms are provided for moving a sheet of media across gap 64.

Figure 2:
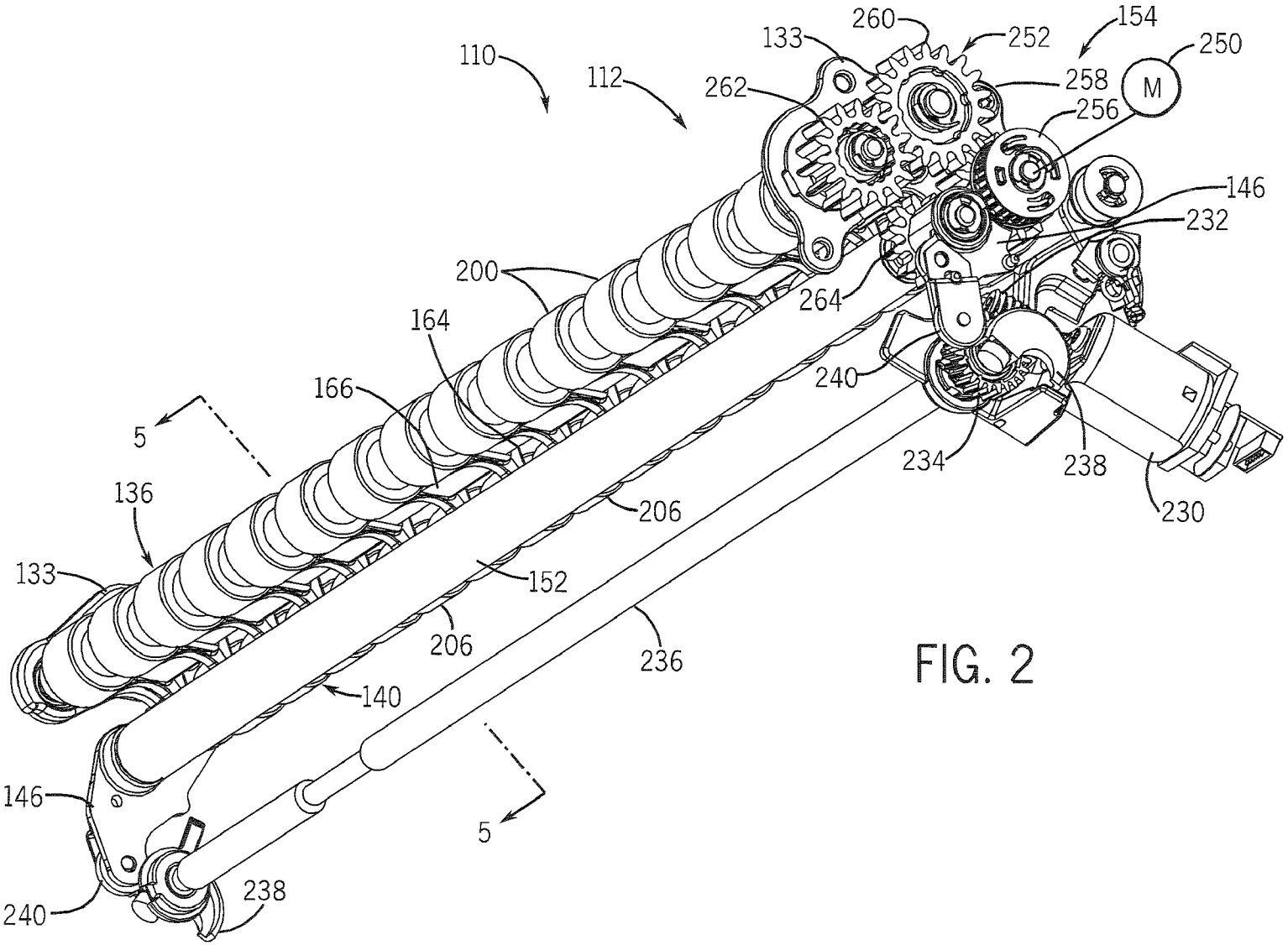
FIG. 2 is a perspective view of another embodiment of the sheet bending apparatus of FIG. 1 according to an example embodiment.
Figure 3:
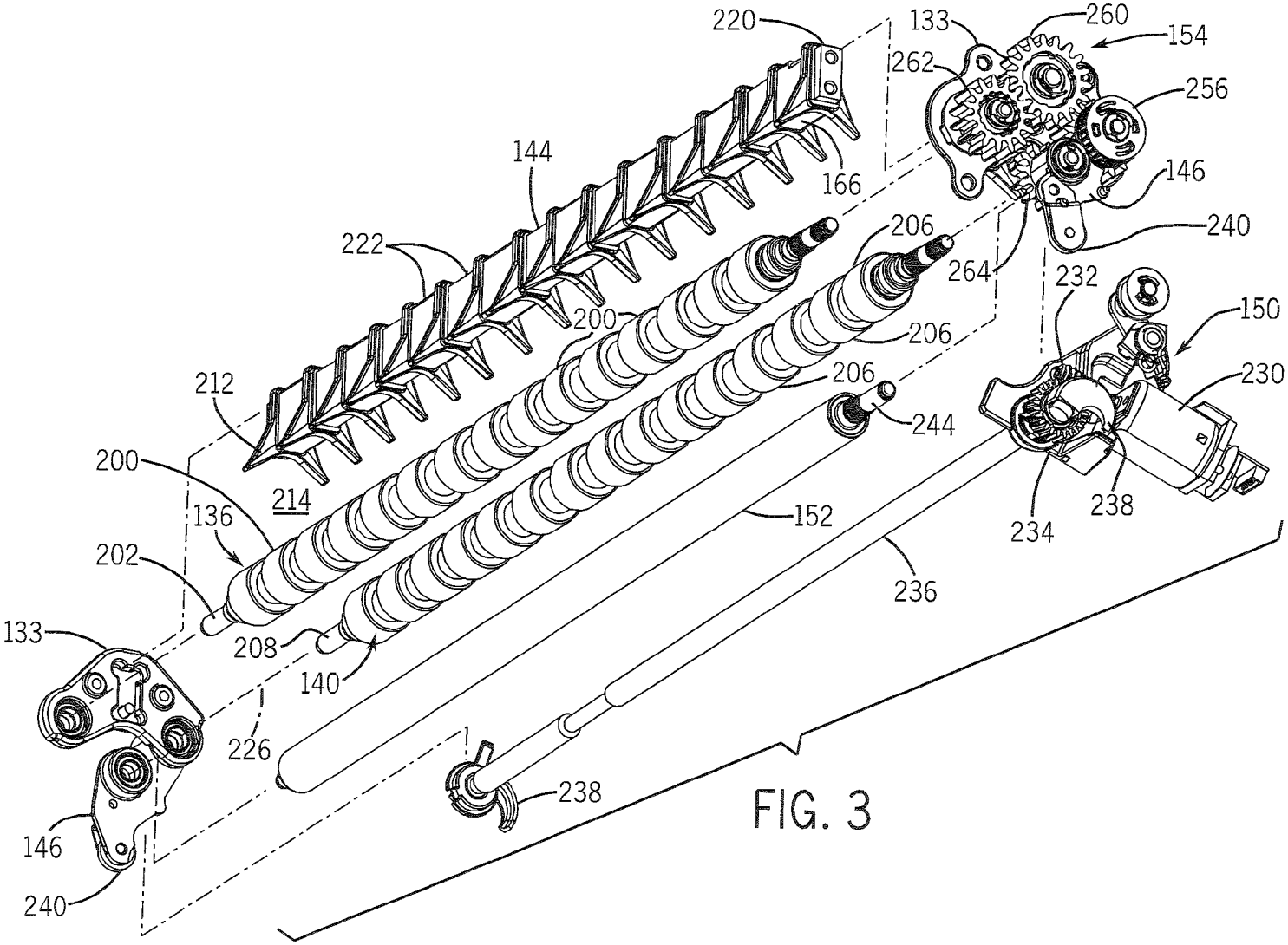
FIG. 3 is an exploded perspective view of the sheet bending apparatus of FIG. 2 according to an example embodiment.
Figure 4:
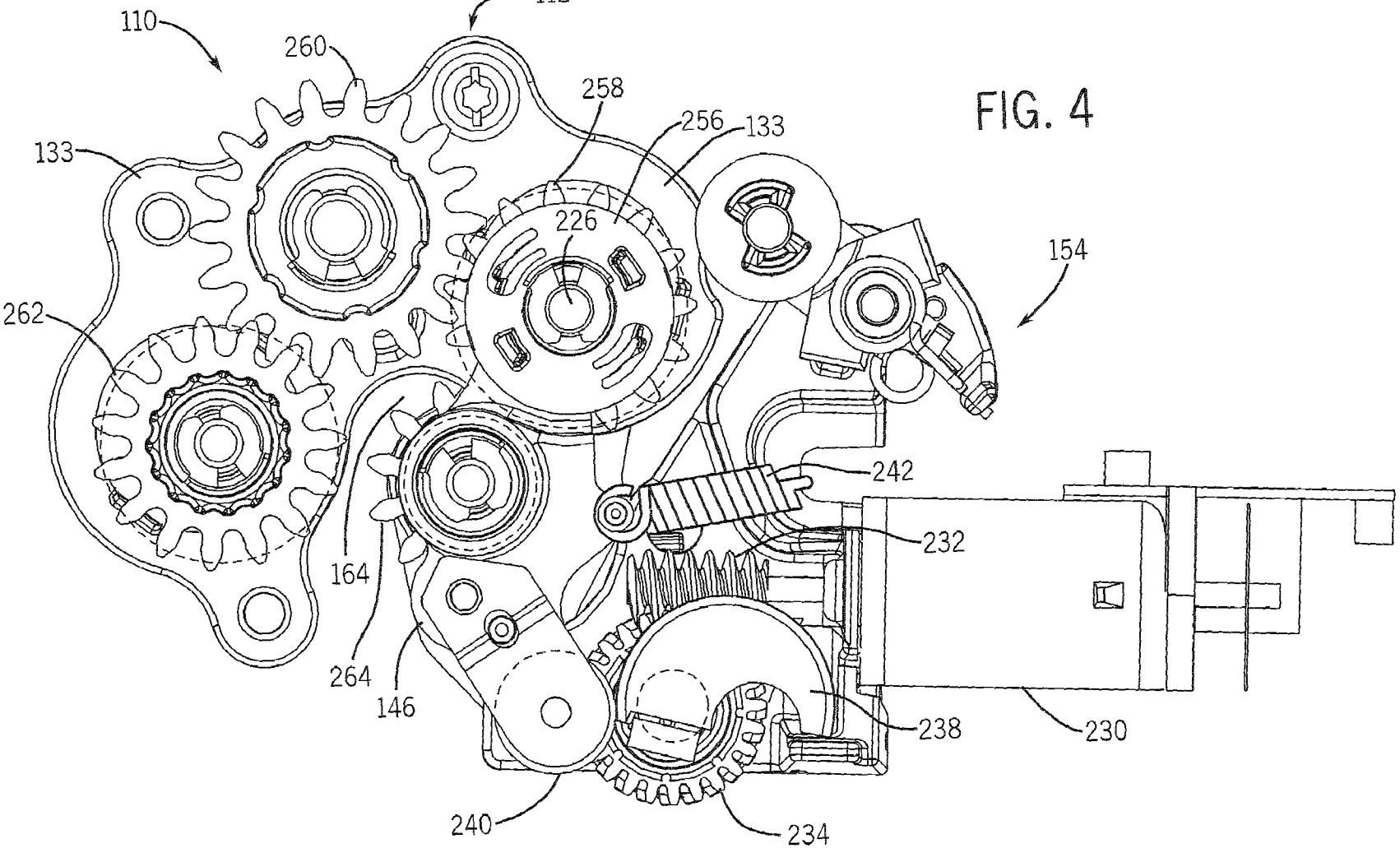
FIG. 4 is an enlarged right and elevation of view of the sheet bending apparatus of FIG. 2 according to an example embodiment.

FIGS. 2-7 illustrate imaging apparatus 110, another embodiment of imaging apparatus 10. Imaging apparatus 110 is substantially identical to imaging apparatus 10 except that imaging apparatus 110 includes sheet bending apparatus 112 in place of sheet bending apparatus 12. Like imaging apparatus 10, imaging apparatus 110 includes sheet input 14, media transport 16, media support 18, imager 20, sheet output 22, duplexer 24, interface 26 and controller 28 (each shown in FIG. 1). As shown by FIGS. 2-4, sheet bending apparatus 112 includes support brackets 133, roller 136, roller-140, backing 144, swing arms 146, actuator 150, roller 152, and an actuator 154. Support brackets 133 comprise stationary structures attached to a frame or other supporting structure of imaging apparatus 110. Support brackets 133 rotationally support roller 136 and roller, 140, stationarily support backing 144 and pivotally support swing arms 146. As shown by FIGS. 2-4, one of brackets 133 additionally supports portions of actuator 150 and actuator 154. Although brackets 133 are illustrated as generally plate-like structures, brackets 133 may have a variety of other shapes and sizes. In addition, brackets 133 may be alternatively incorporated as part of a remainder of the housing or frame of imaging apparatus 110.

Roller 136 comprise a series or set of individual rollers 200 spaced apart from one another and affixed to support shaft 202. Each individual roller 200 is configured to grip and engage a sheet of media to move the sheet of media. In one embodiment, each individual roller 200 is formed from a compressible rubber-like material. Shaft 202 supports rollers 200 and has opposite ends journaled to brackets 133. Shaft 202 is further affixed to actuator 154 as will be described hereafter.

Figure 5:
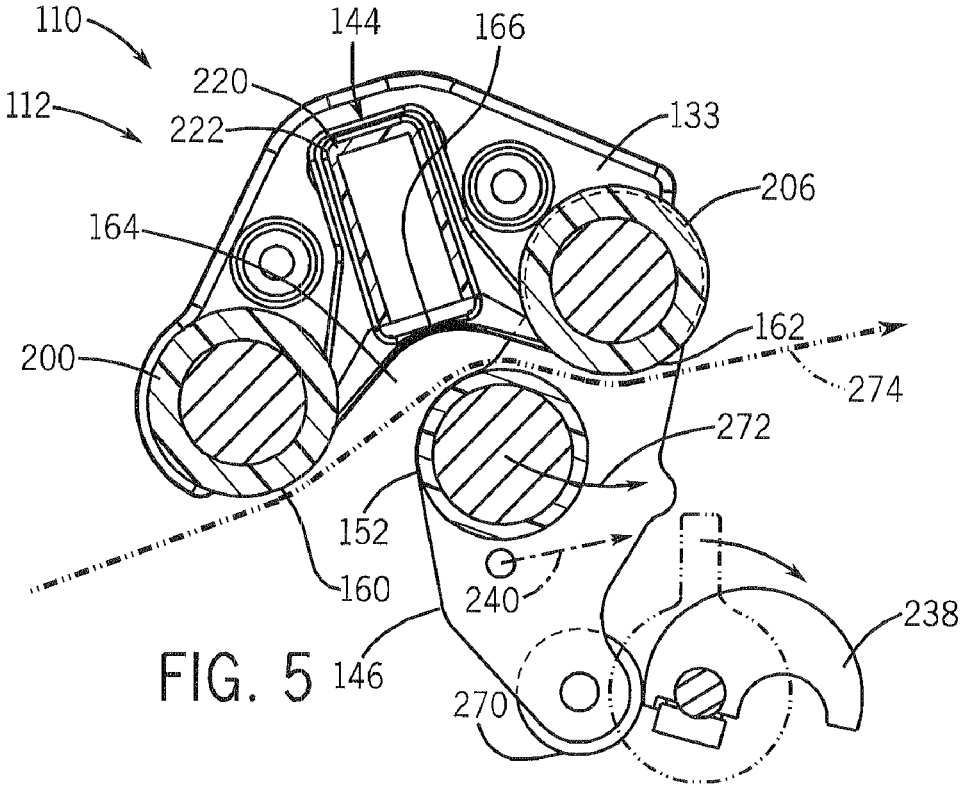
FIG. 5 is a sectional view of the sheet bending apparatus of FIG. 2 in a first state according to an example embodiment.

Roller 140 is similar to roller 136 except the roller 140 is located on an opposite side of backing 144. Roller 140 comprises a series or set of individual rollers 206 spaced apart from one another and affixed to a support shaft 208. Each individual roller 206 is configured to grip and engage a sheet of media to move the sheet of media. Like shaft 202, shaft 208 has opposite ends journaled to brackets 133 and also has an end portion affixed to a portion of actuator 154. Rollers 136 and 140 provide media contacting surfaces 160 and 162 which are separated by a gap 164 as seen in FIG. 5. Gap 164 comprises an opening, cavity, channel or void in which roller 152 is positioned to bend a sheet of media within 164 as will be described in more detail hereafter.

Backing 144 comprises an elongated structure located between rollers 136 and 140 and retracted within or behind gap 164. Backing 144 provides a surface 166 against which a sheet being bent may be pressed by roller 152. Surface 166 is stationary and substantially inflexible. As a result, surface 166 is less subject to stretching, deformation or wear over time. Moreover, in contrast to other systems which include a belt against which a sheet is bent, backing 144 is less likely to skew a sheet of media and is less complex, less expensive and more compact, omitting tensioning mechanisms.

As shown by FIG. 3, backing 144 additionally includes a plurality of spaced fingers 212 and 214. Fingers 212 are spaced along the axis of backing 144 and extend from a first side of surface 166. Fingers 212 partially project into spaces between individual rollers 200 such that fingers 212 and rollers 200 are interleaved with one another. Fingers 212 guide entry of a sheet of media into gap 164 between surface 166 and roller 152.

Fingers 214 are spaced along the axis of backing 144 and extend from an opposite second side of surface 166. Fingers 214 partially project into spaces between individual rollers 206 such that fingers 214 and rollers 206 are interleaved with one another. Fingers 214 guide discharge of a sheet of media from gap 164. Because fingers 212 and 214 are interleaved with rollers 136 and 140, sheets of media may be more smoothly positioned within gap 164 with reduced skewing of the sheet of media. In other embodiments, one or both of fingers 212 and 214 may be omitted or may have other configurations.

In one example embodiment illustrated, backing 144 is similar to a human spine. Backing 144 is formed from an elongated rectangular bar 220 about which are slightly positioned segments 222. Segments 222 are arranged on shaft 220 in an end-to-end fashion along bar 220. Each segment 222 comprises a rectangle or tubular member configured to slide over bar 220, one of fingers 212 and one of fingers 214. In the particular example shown, each segment 222 is integrally formed as a single unitary body. For example, in one embodiment, each segment 222 is integrally formed as a single unitary body out of a polymer. In other embodiments, segments 222 may be formed from other materials, may have other configurations or may be omitted where backing 144 is formed in other manners.

Swing arms 146 comprise elongate rigid structures pivotably coupled to brackets 133 and rotationally supporting roller 152. Swing arms 146 pivot about an axis 226 which is also the rotational axis of roller 140. Swing arms 146 pivot between a first extreme position in which roller 152 is withdrawn from gap 164 by an extent to a second extreme position in which roller 152 extends into gap 164 against surface 166. Swing arms 146 is configured to support roller 152 and any of a plurality of positions between such extreme positions. As shown by FIG. 4, swing arm 146 is resiliently biased towards the first position by a coil spring 242. In other embodiments, spring 242 may be omitted.

Actuator 150 comprises a mechanism configured to move swing arms 146 and roller 152 between various sheet bending positions in which roller 152 extends into gap 164 by varying extents. In the example illustrated, actuator 150 includes motor 230, worm gear 232, helical gear 234, shaft 236, cams 238 and cam followers 240. Motor 230 comprises an electric motor, such as a DC motor, and an output shaft (not shown) connected worm gear 232. Worm gear 232 is in meshing engagement with helical gear 234. Helical gear 234 is fixedly coupled to shaft 236. Shaft 236 comprises an elongated rigid shaft having opposite ends journaled to a bracket or frame (not shown) of imaging apparatus 110. Shaft 236 is affixed to cams 238. Cam followers 240 comprise discs or rollers rotationally supported by swing arm 146 and configured to rotate along surfaces of cams 238. In the example illustrated, cam followers 240 are held against cams 238 by spring 242 (shown in FIG. 4). As will be described hereafter, rotation of shaft 236 and cams 238 move cam followers 240 to pivot swing arm 146 and roller 152. In other embodiments, actuator 150 may comprise other mechanisms configured to pivot swing arms 146. In still other embodiments, swing arms 146 and actuator 150 may have other configurations so as to selectively move roller 152 between multiple (greater than two) sheet bending positions within gap 164 (shown in FIG. 2).

Roller 152 comprises an elongate cylindrical roller rotationally supported by swing arms 146. In the particular example illustrated, roller 152 has an outer circumferential surface configured to engage and grip media extending across gap 164. In one embodiment, roller 152 has a diameter of about 10 mm and is formed from one or more materials having a relatively high coefficient of friction with various types of media. For example, in one embodiment, roller 152 is formed from a grit-coated shaft. In the particular example illustrated, roller 152 has an axial end portion 244 fixed to a portion of actuator 154 such that roller 152 may be rotationally driven. In other embodiments, roller 152 may alternatively freely rotate.

Actuator 154 comprises a mechanism configured to rotationally drive each of rollers 136, 140 and 152. Actuator 154 includes motor 250 and drive train 252. Motor 250 has an output shaft operably coupled to drive train 252. In one embodiment, motor 250 comprises a DC motor. In other embodiments, motor 250 may comprise other motors.

Drive train 252 transmits torque from motor 250 to each of rollers 136, 140 and 152. Drive train 252 includes pulley 256 and gears 258, 260, 262 and 264. Pulley 256 receives torque via a belt (not shown) and is affixed to shaft 208 so as to rotate with shaft 208. Gear 258 is also affixed to shaft 208. In other embodiments, pulley 256 and gear 258 may be affixed to one another, whereas one is affixed to shaft 208. Gear 258 rotates about axis 226 about which swing arms 146 pivot. Gear 258 has teeth in meshing engagement with both gears 260 and 264.

Gear 260 is rotationally supported by bracket 133 and has teeth in meshing engagement with teeth of gear 258 and gear 262. Gear 262 is affixed to shaft 202 such that rotation of gear 262 also results in rotation of shaft 202 and its rollers 200. Gear 264 is affixed to end portion 244 of roller 152 such that rotation of gear 264 also results in rotation of roller 152.

In operation, torque is transmitted to roller 140 via pulley 256 and gear 258. Torque is transmitted to roller 136 via pulley 256, gear 258, gear 260 and gear 262. Torque is transmitted to roller 152 via pulley 256, gear 258, and gear 264. As a result, sheets of media are more uniformly deformed and transported across gap 164. Because swing arm 146 supporting gear 264 pivots about axis 226 which is also the axis about which gear 258 rotates, transmission of torque to gear 264 and roller 152 may be maintained as roller to 152 is repositioned.

Although gears 258, 260 and 262 have substantially the same size such that rollers 136 and 140 are rotationally driven at the same speed, in other embodiments, one or both of gears 260 and 262 may have other dimensions such that rollers 136 and 140 are driven at different speeds while deriving power from the same single actuator 154. Although drive train 252 is illustrated as including a pulley and a gear train, in other embodiments, drive train 252 may alternatively comprise an arrangement of belts and pulleys, an arrangement of chains and sprockets, or an arrangement of gears or combinations thereof. Although actuator 154 is illustrated as rotationally driving each of rollers 136, 140 and 152, in other embodiments, actuator 154 may alternatively rotationally drive fewer than all three such rollers. In such embodiments, rollers not driven by actuator 154 may be driven by other independent actuators or may alternatively be allowed to freely rotate (not under power).

Figure 6:
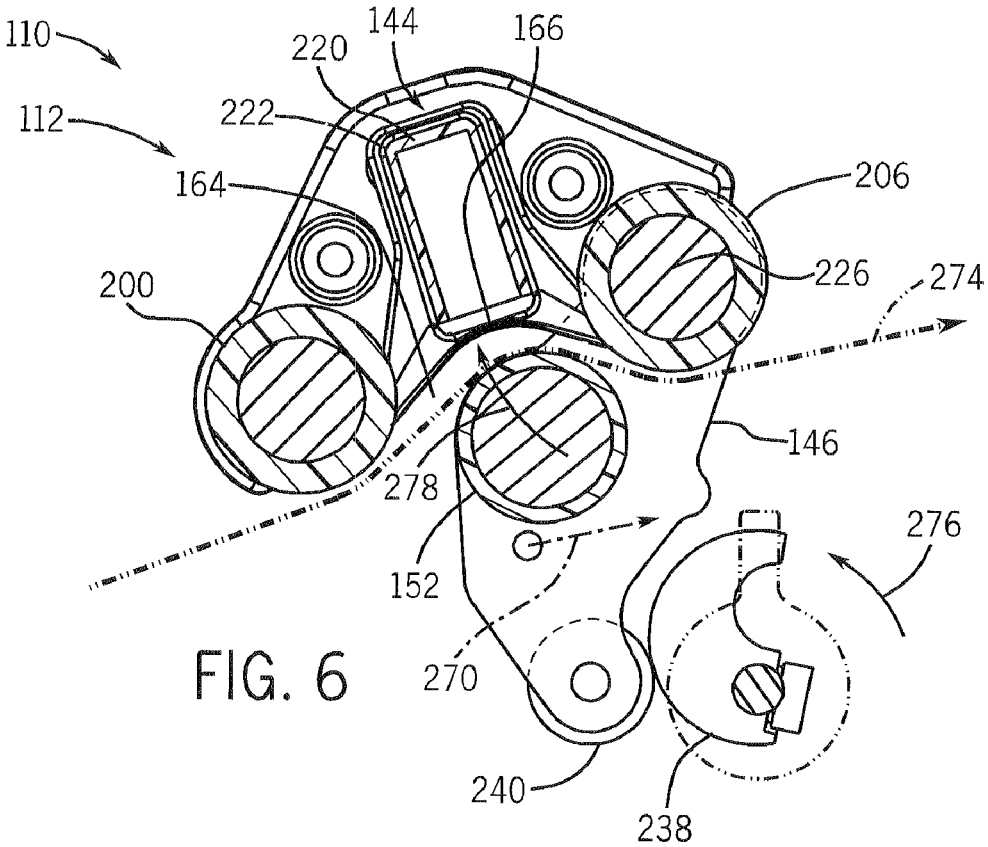
FIG. 6 is a sectional view of the sheet bending apparatus of FIG. 2 in a second state according to an example embodiment.
Figure 7:
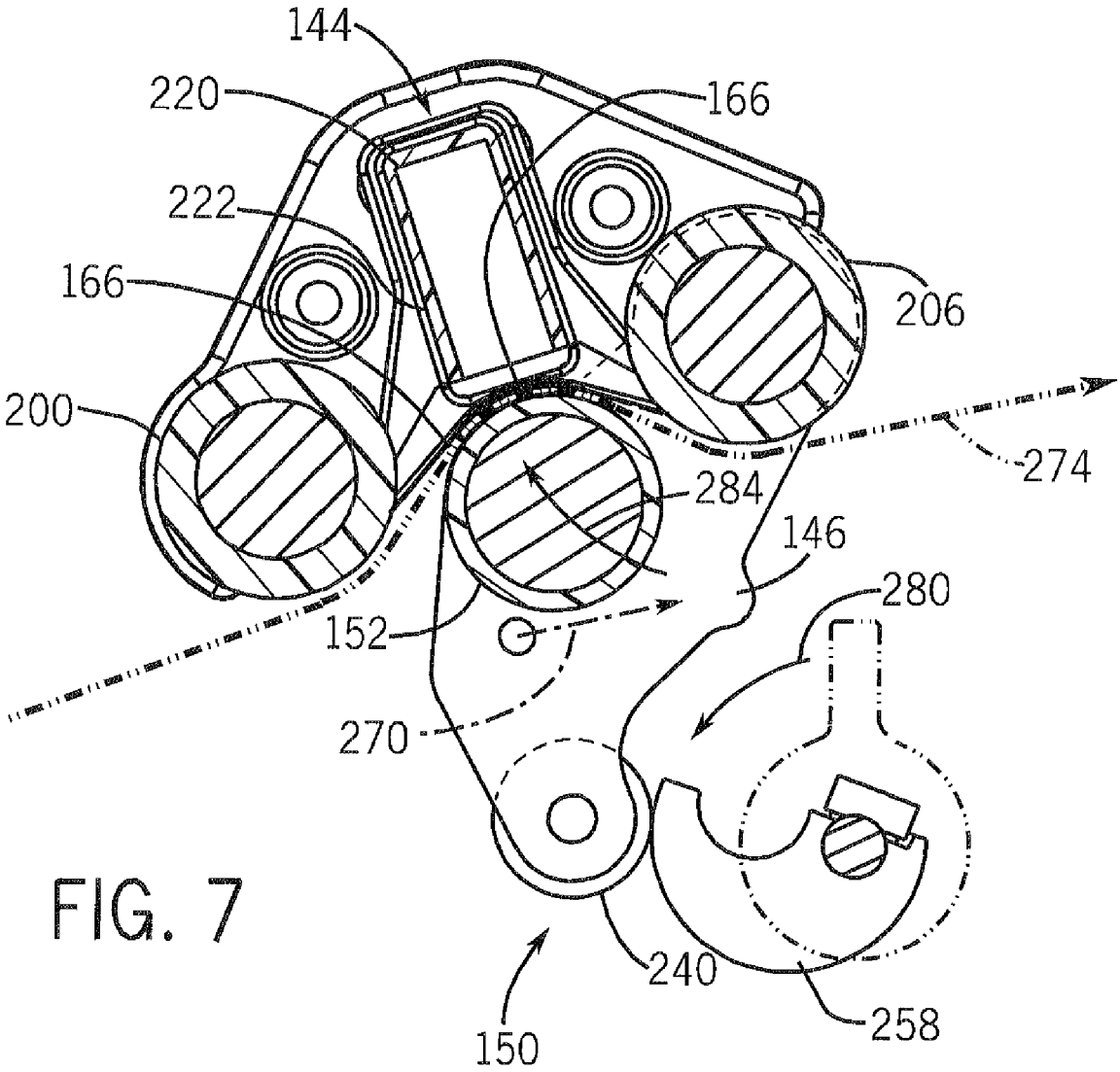
FIG. 7 is a sectional view of the sheet bending apparatus of FIG. 2 in a third state according to an example embodiment.

FIGS. 5-7 illustrate selective positioning of roller 152 to bend or de-curl media to different extents. FIG. 5 illustrates an extreme withdrawn position in which roller 152 is withdrawn from gap 164 to a largest extent. As illustrated by FIG. 5, Spring 242 (shown in FIG. 4) resiliently biases swing arm 146 in a direction indicated by arrow 270 so as to urge cam follower 240 into contact with cam 238. As a result, roller 152 is pivoted in the direction indicated by arrow 272 to the position shown. In this position, a sheet of media (schematically represented by broken lines 274) is bent to the least extent.

FIG. 6 illustrates a sheet of media being bent to a slightly larger extent. In particular, FIG. 6 illustrates rotation of cam 238 in the direction indicated by arrow 276. This rotation is the result of motor 230 driving worm gear 232 which rotates gear 234 and cam 238 (shown in FIG. 4). The rotation of cam 238 causes cam 238 to move against cam follower 240 to pivot swing arm 146 about axis 226 and against the bias exerted by spring 242 (shown in FIG. 4) exerted in the direction indicated by arrow 270. Pivoting of swing arm 146 results in roller 152 being moved to a greater extent into gap 164 as indicated by a arrow 278.

FIG. 7 illustrates an extreme inserted position in which roller 152 extends into gap 164 to a largest extent. In particular, FIG. 7 illustrates rotation of cam 238 in the direction indicated by arrow 280. This rotation is the result of motor 230 driving worm gear 232 which rotates gear 234 and cam 238 (shown in F*ig*. 4). The rotation of cam 238 causes cam 238 to move against cam follower 240 to pivot swing arm 146 about axis 226 and against the bias exerted by spring 242 (shown in FIG. 4) exerted in the direction indicated by arrow 270. Pivoting of swing arm 146 results in roller 152 being moved to a greater extent into gap 164 as indicated by arrow 284. In the example illustrated, roller 152 contacts and presses sheet 274 against surface 166.

FIGS. 5-7 illustrate one example set of various positions at which roller 152 may be moved. In other embodiments, actuator 150 may alternatively be configured to move roller 152 into and out of gap 164 to other extents. For example, in other embodiments, roller 152 may extend into gap 164 to a lesser extent in its extreme inserted position. Likewise, roller 152 may be withdrawn from gap 164 to a greater extent in its extreme withdrawn position. Because cams 238 provide a continuously smooth surface eccentric to an axis of rotation of cams 238, positioning of roller 152 is smoothly adjusted as swing arm 146 pivots about axis 226. In other embodiments, the cam follower engaging surfaces above cam 238 may have other configurations which result in roller 152 being moved between predetermined discrete positions. In other embodiments, actuator 150 may have other configurations or other mechanisms for selectively moving roller 152 between various positions with respect to gap 164.

Figure 8:
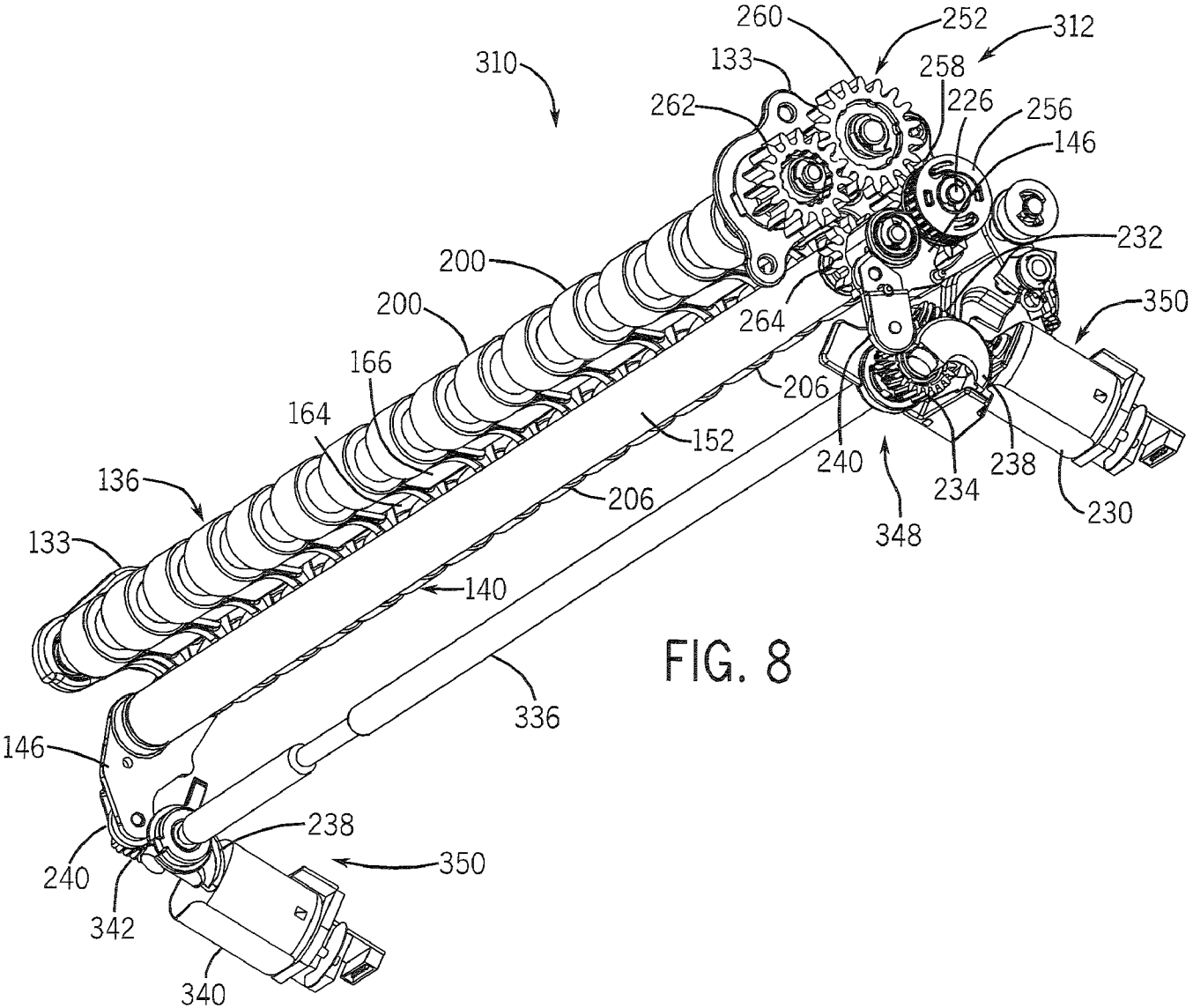
FIG. 8 is a perspective view of another embodiment of the sheet bending apparatus of FIG. 1 according to an example embodiment.
Figure 9:
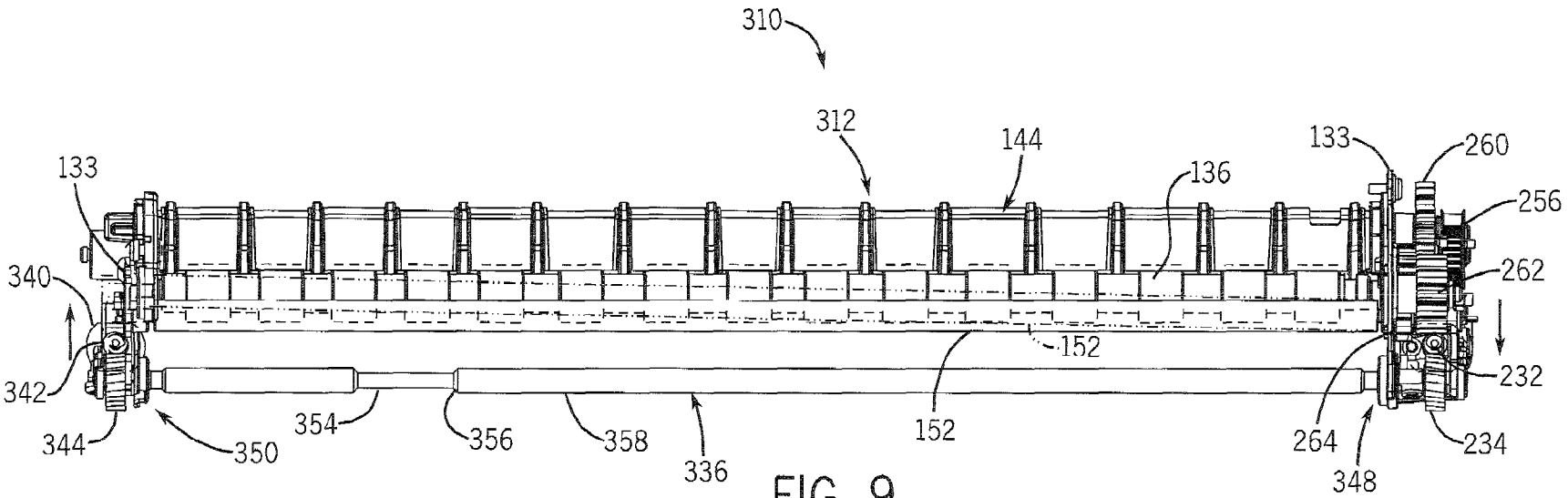
FIG. 9 is a front elevation of you of the sheet bending apparatus of FIG. 8 illustrating different positioning of a roller according to an example embodiment.

FIGS. 8 and 9 illustrate imaging apparatus 310, another embodiment of imaging apparatus 10. Imaging apparatus 310 is substantially similar to imaging apparatus 110 except that imaging apparatus 310 includes sheet bending apparatus 312, another embodiment of sheet bending apparatus 12. Sheet bending apparatus 312 is similar to sheet bending apparatus 112 (shown in FIGS. 2-7) except that sheet bending apparatus 312 includes actuator 350 in place of actuator 150. Those remaining elements of apparatus 310 and sheet bending apparatus 312 which correspond to apparatus 110 and sheet bending apparatus 112 are numbered similarly. Like apparatus 110, apparatus 310 includes sheet input 14, media transport 16, media support 18, imager 20, sheet output 22, duplexer 24, interface 26 and controller 28 (each shown in FIG. 1).

Actuator 350 is similar to actuator 150 (shown and described with respect to FIGS. 2-7) except that actuator 350 includes shaft 336 in place of shaft 236 and additionally includes motor 340, worm gear 342 and helical gear 344 (shown in FIG. 9). Shaft 336 comprises an elongate shaft extending between and affixed to opposite cams 238. Shaft 336 has opposite ends 348, 350 journaled to a frame or other supporting structure (not shown) of apparatus 310 and supporting cams 238. Unlike the opposite ends of shaft 236 (shown in FIG. 3), the opposite ends 348 and 350 of shaft 336 are configured to rotate relative to one another. In one embodiment, shaft 336 includes a first portion 354 at end 350 which is rotationally positioned within an internal bore 356 of a second portion 358. In other embodiments, other mechanisms may be used to facilitate rotation of end 350 relative to end 348.

Motor 340, worm gear 342 and helical gear 344 are substantially similar to motor 230, worm gear 232 and helical gear 234 (shown in FIG. 3) except that motor 340, worm gear 342 and helical gear 344 are supported at an opposite end of shaft 336. While motor 230, worm gear 232 and helical gear 234 selectively rotate cam 238 at end 348, motor 340, worm gear 342 and helical gear 344 selectively rotate cam 238 at end 350. As a result, swing arm 146 at end 348 may be pivoted about axis 226 to a greater, lesser or the same extent as swing arm 146 at end 350 is pivoted about axis 226.

As shown in FIG. 9, by selectively pivoting swing arms 146 at ends 348 and 350, roller 152 may be moved between a first position (shown in solid lines) in which roller 152 extends along an axis substantially parallel to backing 144, roller 136 and roller 140 and a second position (shown in broken lines) in which roller 152 extends along an axis oblique to backing 144, roller 136 and roller 140. As a result, roller 152 will exert a different force at ends 348 and 350. By applying such a different force to a sheet of media, detected skew of the sheet of media (from sensor 58 shown in FIG. 1) may be reduced or corrected. Although FIG. 9 illustrates roller 152 at and 350 positioned closer to backing 144 than at end 348, in other circumstances, this may be reversed.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An apparatus comprising:

a first surface;

a second surface spaced from the first surface by a gap;

a third surface between the first surface and the second surface and retracted within the gap;

a first roller opposite the third surface and configured to extend at least partially within the gap to bend a sheet of media within the gap, wherein the first roller is rotationally driven;

an imager configured to form an image on a sheet of media, wherein the first roller is configured to contact and bend the sheet of media into the gap;

a drum configured and located to support the sheet of media as the image is being formed upon the sheet of media and prior to the sheet being bent within the gap;

a second roller providing the first surface; and a third roller providing the second surface, wherein the third surface is inflexible and stationary.

2. The apparatus of claim 1, wherein the first roller is movably supported between a plurality of positions relative to the third surface and wherein the apparatus further comprises:

an actuator configured to selectively move the first roller between the plurality of positions relative to the third surface; and a controller configured to generate control signals directing the actuator to position the first roller at a selected one of the plurality of positions based upon a thickness of the sheet.

3. The apparatus of claim 2 further comprising a swing arm pivotally supporting the first roller.

4. The apparatus of claim 3 further comprising a drive train operably coupled to the first roller to rotationally drive the first roller, wherein the drive train includes a member rotating about an axis and wherein the swing arm is pivotable about the axis.

5. The apparatus of claim 3 further comprising a first cam operably coupled to the first swing arm, wherein rotation of the first cam moves the first roller between the plurality of positions.

6. The apparatus of claim 5, wherein the first cam is proximate a first end of the first roller and wherein the apparatus further comprises a second cam proximate a second opposite end of the first roller.

7. The apparatus of claim 6, wherein the first cam and the second cam are independently actuatable to move the first roller between a first orientation in which the first roller extends along a first axis substantially parallel to the third surface and a second orientation in which the first roller extends along a second axis oblique to the third surface.

8. The apparatus of claim 1, wherein the second roller and the third roller are configured to be driven at different speeds.

9. The apparatus of claim 1 further comprising:

first spaced fingers extending from the third surface; and a first set of rollers providing the first surface and interleaved between the first fingers.

10. The apparatus of claim 9 further comprising:

second spaced fingers extending from the third surface; and a second set of rollers providing the second surface and interleaved between the second fingers, wherein the third surface extends along a first axis, wherein the first set of rollers extends along a second axis parallel to the first axis, wherein the second set of rollers extends along a third axis parallel to the second axis and on an opposite side of the first axis as the second axis, wherein the first set of fingers extend from the third surface in a first direction from the first axis towards the second axis and wherein the second set of fingers extend from the third surface in a second direction from the first axis towards the third axis.

11. The apparatus of claim 10 further comprising a plurality of segments joined to one another along the first axis, each segment providing a portion of the third surface, the first spaced fingers and the second spaced fingers.

12. The apparatus of claim 1, wherein the imager is configured to form an image on a portion of the sheet of media while the portion is curved by an opposite underlying portion of the drum.

13. The apparatus of claim 3 further comprising:

first spaced fingers extending from the third surface; and a first set of rollers providing the first surface and interleaved between the first fingers.

14. The apparatus of claim 10, wherein one of the first spaced fingers, the third surface and a corresponding one of the second spaced fingers form a continuous substantially arcuate surface in the gap, centered about a rotational axis of the first roller and extending between the first set of rollers and the second set of rollers.

15. The apparatus of claim 1, wherein the sheet of media wraps about a first axis of the drum on a first side of the sheet of media as the image is being formed upon the sheet of media, wherein the first roller rotates about a second axis and wherein the first roller bends the sheet of media within the gap about the second axis while the second axis extends on a second side of the sheet of media opposite the first side.

16. An apparatus comprising:

a first surface;

a second surface spaced from the first surface by a gap;

a third surface between the first surface and the second surface and retracted within the gap;

a first roller opposite the third surface and configured to extend at least partially within the gap to bend a sheet of media within the gap, wherein the first roller is rotationally driven;

an imager configured to form an image on a sheet of media, wherein the first roller is configured to contact and bend the sheet of media into the gap;

a drum configured and located to support the sheet of media as the image is being formed upon the sheet of media and prior to the sheet being bent within the gap, wherein the first roller is movably supported between a plurality of positions relative to the third surface;

an actuator configured to selectively move the first roller between the plurality of positions relative to the third surface; and a controller configured to generate control signals directing the actuator to position the first roller at a selected one of the plurality of positions based upon a thickness of the sheet;

a swing arm pivotally supporting the first roller;

a first cam operably coupled to the first swing arm, wherein rotation of the first cam moves the first roller between the plurality of positions, wherein the first cam is proximate a first end of the first roller; and a second cam proximate a second opposite end of the first roller.

17. The apparatus of claim 16, wherein the first cam and the second cam are independently actuatable to move the first roller between a first orientation in which the first roller extends along a first axis substantially parallel to the third surface and a second orientation in which the first roller extends along a second axis oblique to the third surface.

18. An apparatus comprising:

a first surface;

a second surface spaced from the first surface by a gap;

a third surface between the first surface and the second surface and retracted within the gap;

a first roller opposite the third surface and configured to extend at least partially within the gap to bend a sheet of media within the gap, wherein the first roller is rotationally driven;

an imager configured to form an image on a sheet of media, wherein the first roller is configured to contact and bend the sheet of media into the gap;

a drum configured and located to support the sheet of media as the image is being formed upon the sheet of media and prior to the sheet being bent within the gap;

a second roller providing the first surface; and a third roller providing the second surface, wherein the second roller and the third roller are configured to be driven at different speeds.

19. An apparatus comprising:

a first surface;

a second surface spaced from the first surface by a gap;

a third surface between the first surface and the second surface and retracted within the gap;

a first roller opposite the third surface and configured to extend at least partially within the gap to bend a sheet of media within the gap, wherein the first roller is rotationally driven;

an imager configured to form an image on a sheet of media, wherein the first roller is configured to contact and bend the sheet of media into the gap;

a drum configured and located to support the sheet of media as the image is being formed upon the sheet of media and prior to the sheet being bent within the gap;

first spaced fingers extending from the third surface; and a first set of rollers providing the first surface and interleaved between the first fingers.

20. The apparatus of claim 19 further comprising:

second spaced fingers extending from the third surface; and a second set of rollers providing the second surface and interleaved between the second fingers, wherein the third surface extends along a first axis, wherein the first set of rollers extends along a second axis parallel to the first axis, wherein the second set of rollers. extends along a third axis parallel to the second axis and on an opposite side of the first axis as the second axis, wherein the first set of fingers extend from the third surface in a first direction from the first axis towards the second axis and wherein the second set of fingers extend from the third surface in a second direction from the first axis towards the third axis.

21. The apparatus of claim 20 further comprising a plurality of segments joined to one another along the first axis, each segment providing a portion of the third surface, the first spaced fingers and the second spaced fingers.

22. The apparatus of claim 20, wherein one of the first spaced fingers, the third surface and a corresponding one of the second spaced fingers form a continuous substantially arcuate surface in the gap, centered about a rotational axis of the first roller and extending between the first set of rollers and the second set of rollers.

23. The apparatus of claim 19, wherein the first roller is movably supported between a plurality of positions relative to the third surface and wherein the apparatus further comprises:

an actuator configured to selectively move the first roller between the plurality of positions relative to the third surface; and a controller configured to generate control signals directing the actuator to position the first roller at a selected one of the plurality of positions based upon a thickness of the sheet; and a swing arm pivotally supporting the first roller.

* * * * *

UNITED STATES PATENT AND TRADEMARK OFFICE

CERTIFICATE OF CORRECTION

PATENT NO. : 7,641,193 B2
APPLICATION NO. : 11/555151
DATED : January 5, 2010
INVENTOR(S) : Louis C. Barinaga et al.

It is certified that error appears in the above-identified patent and that said Letters Patent is hereby corrected as shown below:

In column 14, line 13, in Claim 20, delete "rollers." and insert -- rollers --, therefor.

Signed and Sealed this

Twenty-ninth Day of June, 2010

David J. Kappos

David J. Kappos
*Director of the United States Patent and Trademark Office*